US006500032B2

(12) United States Patent
Endo et al.

(10) Patent No.: US 6,500,032 B2
(45) Date of Patent: Dec. 31, 2002

(54) FEMALE METAL TERMINAL AND METHOD OF PRODUCING THE SAME

(75) Inventors: Mitsuo Endo, Shizuoka (JP); Hisashi Tsukamoto, Shizuoka (JP); Hitoshi Saito, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/749,367

(22) Filed: Dec. 28, 2000

(65) Prior Publication Data

US 2001/0014561 A1 Aug. 16, 2001

Related U.S. Application Data

(62) Division of application No. 09/021,861, filed on Feb. 11, 1998.

(30) Foreign Application Priority Data

Feb. 13, 1997 (JP) ..... 9-029265

(51) Int. Cl.[7] ..... H01R 13/11; H01R 11/22

(52) U.S. Cl. ..... 439/857

(58) Field of Search ..... 439/857, 856, 439/839, 886; 29/874; 72/370.11, 370.16, 370.1

(56) References Cited

U.S. PATENT DOCUMENTS

| | | | | | |
|---|---|---|---|---|---|
| 3,818,423 | A | | 6/1974 | McDonough | 439/857 |
| 4,607,907 | A | | 8/1986 | Bogursky | 439/886 |
| 4,776,651 | A | | 10/1988 | Paulo | 439/857 |
| 5,067,916 | A | * | 11/1991 | Denlinger et al. | 439/857 |
| 5,106,329 | A | | 4/1992 | Maeshima et al. | 439/851 |
| 5,413,509 | A | * | 5/1995 | Castaldo | 439/851 |
| 5,690,518 | A | * | 11/1997 | Roy et al. | 439/851 |
| 5,730,606 | A | | 3/1998 | Sinclair | 439/70 |
| 5,897,394 | A | | 4/1999 | Adachi | 439/496 |

* cited by examiner

*Primary Examiner*—Javaid Nasri
(74) *Attorney, Agent, or Firm*—Morgan, Lewis & Bockius LLP

(57) ABSTRACT

A female metal terminal includes resilient contact piece portions, and a tubular portion supporting the resilient contact piece portions in a cantilever manner. A longitudinal cross-sectional shape of each resilient contact piece portion is changed by forming an opening or a projection so that a load of contact of the female metal terminal with a male metal terminal can be adjusted in accordance with electrical conductivity of a plating material applied to the female metal terminal, without changing a contour shape of the female metal terminal in a developed condition.

3 Claims, 8 Drawing Sheets

FEMALE METAL TERMINAL AND METHOD OF PRODUCING THE SAME

This is a divisional of copending application Ser. No. 09/021,861 filed on Feb. 11, 1998.

BACKGROUND OF THE INVENTION

This is a divisional of now abandoned application Ser. No. 09/021,861 filed on Feb. 11, 1998. This invention relates to a female metal terminal and a method of producing the same, and more particularly to a female metal terminal used to connect a wire harness and the like in an automobile, and a method of producing this female metal terminal.

Recently, for the purpose of protecting a driver and a passenger in the event of an emergency, safety devices, such as an air bag and a seat belt with a pre-tensioner, have been provided in an automobile. In a wire harness of such a safety device required to operate in the event of an emergency, there are used female metal terminals plated with gold of a good electrical conductivity, and in wire harnesses of other devices, there are used female metal terminals plated, usually, with tin, since gold is expensive. Thus, at least two kinds of female metal terminals, plated respectively with different materials, are suitably used in recent automobiles.

Generally, a female metal terminal includes a tubular proximal end portion, and a pair of resilient contact piece portions which are separated from each other by slits extending longitudinally from a distal end of the terminal to the proximal end portion, and are supported by the proximal end portion in a cantilever manner. This female metal terminal is decreasing in diameter progressively from the proximal end portion toward the distal end, and a constricted portion, provided at the distal end portion, serves as a contact portion. When a bar-like male terminal is inserted into the female metal terminal through the distal end thereof, the male terminal contacts the contact portion of the female metal terminal, thereby creating an electrical connection therebetween.

In the female metal terminal of the above construction, the longer the cantilever length of the resilient contact piece portions (supported in a cantilever manner) is, the lower the load of contact with the male terminal is, and in contrast, the shorter the cantilever length is, the higher the contact load is. Therefore, the cantilever length of the resilient contact piece portions of the female metal terminal plated with tin of a low electrical conductivity, is made shorter than the cantilever length of the resilient contact piece portions of the female metal terminal plated with gold of a high electrical conductivity, and by doing so, the load of contact of the tin-plated female metal terminal with the male terminal is made higher than that of the gold-plated female metal terminal.

U.S. Pat. No. 5,067,916 discloses a method of adjusting-a load of contact with a male terminal in accordance with a plating material applied to resilient contact piece portions of a female metal terminal. FIG. 9(*a*) is a developed, plan view of a conventional gold-plated female metal terminal 71 (in a pressed or stamped condition) disclosed in U.S. Pat. No. 5,067,916, and FIG. 9(*b*) is a developed plan view of a tin-plated female metal terminal 72 in a pressed condition.

As shown in FIGS. 9(*a*) and 9(*b*), the angle θ1 between a tubular portion (proximal end portion) 73 and a resilient contact piece portion 74 of the gold-plated female metal terminal 71 is smaller than the angle θ2 of a tubular portion (proximal end portion) 75 and a resilient contact piece portion 76 of the tin-plated female metal terminal 72.

Namely, by changing the width of the proximal end portion of the resilient contact piece portion, the load of contact with the male terminal is adjusted in accordance with the plating material applied to the resilient contact piece portion of the female metal terminal.

As described above, in the recent automobile, several kinds of female metal terminals are required, depending on the electrical conductivity of the plating material applied to the surface of the female metal terminals. When providing the different female metal terminals by using the above method in which the contact load is adjusted by changing the length of the resilient contact piece portions, several kinds of dies are required for pressing or stamping the female metal terminals, and therefore the production process is cumbersome, and also the cost of the dies and the production cost are increased, and the handling is not easy. And besides, the length of the resilient contact piece portions differs depending on the plating material, and therefore it is necessary to prepare several kinds of housings, depending on this length, and this increases the production cost.

Furthermore, when the different female metal terminals are provided by using the method disclosed in U.S. Pat. No. 5,067,916, the only difference between the gold-plated female metal terminal and the tin-plated female metal terminal is that the proximal end portions of the resilient contact piece portions 74 and 76 are slightly different in width, and therefore the two kinds of female metal terminals have almost the same appearance, and also the dies for respectively forming these female metal terminals are almost the same, and therefore it is difficult to distinguish them from each other from the appearance, and not only a confusion but also a mistake may be involved in the production.

SUMMARY OF THE INVENTION

The present invention has been made in view of the above problems, and an object of the invention is to provide a female metal terminal and a method of producing the same, in which a load of contact with a male metal terminal can be adjusted in accordance with the electrical conductivity of a plating material applied to a surface of the female metal terminal, without changing a contour shape (including a length and a width) in a developed condition.

The object of the invention has been achieved by a method of producing female metal terminals plated respectively with gold and tin, comprising the steps of:

forming, by pressing, the female metal terminal which includes resilient contact piece portions, and a tubular portion supporting the resilient contact piece portions in a cantilever manner, a longitudinal cross-sectional shape of the resilient contact piece portions being changed so that a load of contact of the female metal terminal with a male metal terminal can be adjusted in accordance with electrical conductivity of a plating material applied to the female metal terminal, without changing a contour shape of the female metal terminal in a developed condition; and forming the resilient contact piece portions and the tubular portion, formed by the pressing operation, into a tubular shape.

The object of the invention has also been achieved by a female metal terminal including resilient contact piece portions, and a tubular portion supporting the resilient contact piece portions in a cantilever manner, a longitudinal cross-sectional shape of the resilient contact piece portions being changed so that a load of contact of the female metal terminal with a male metal terminal can be adjusted in accordance with electrical conductivity of a plating material applied to the female metal terminal, without changing a contour shape of the female metal terminal in a developed condition.

DETAILED DESCRIPTION OF THE INVENTION

A first embodiment of the present invention will now be described with reference to FIG. 1.

Figure 1A:
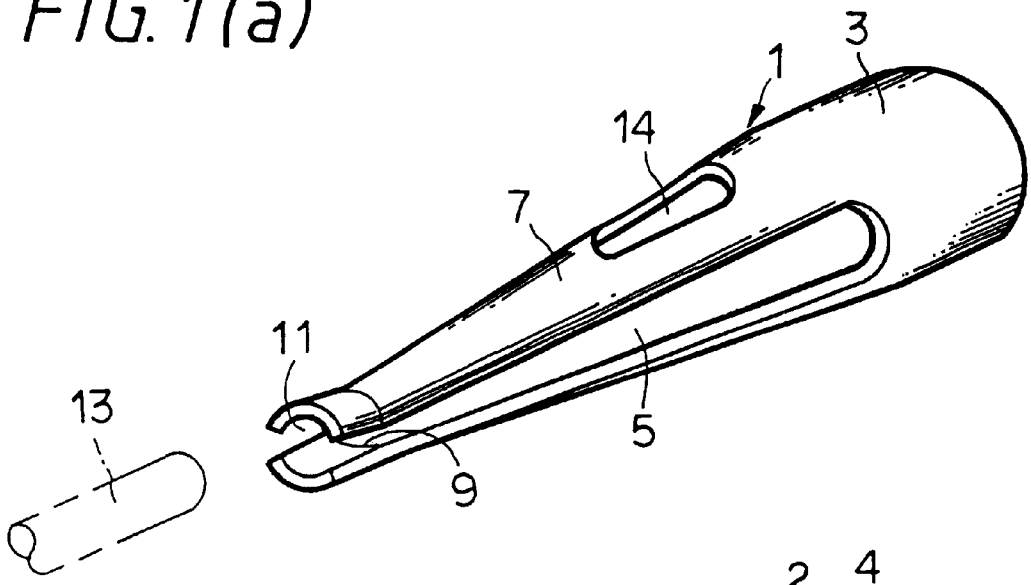
FIGS. 1(*a*) and 1(*b*) are perspective views of two kinds of female metal terminals according to a first embodiment of the invention, FIG. 1(*a*) showing a gold-plated female metal terminal, and FIG. 1(*b*) showing a tin-plated -female metal terminal.
Figure 1B:
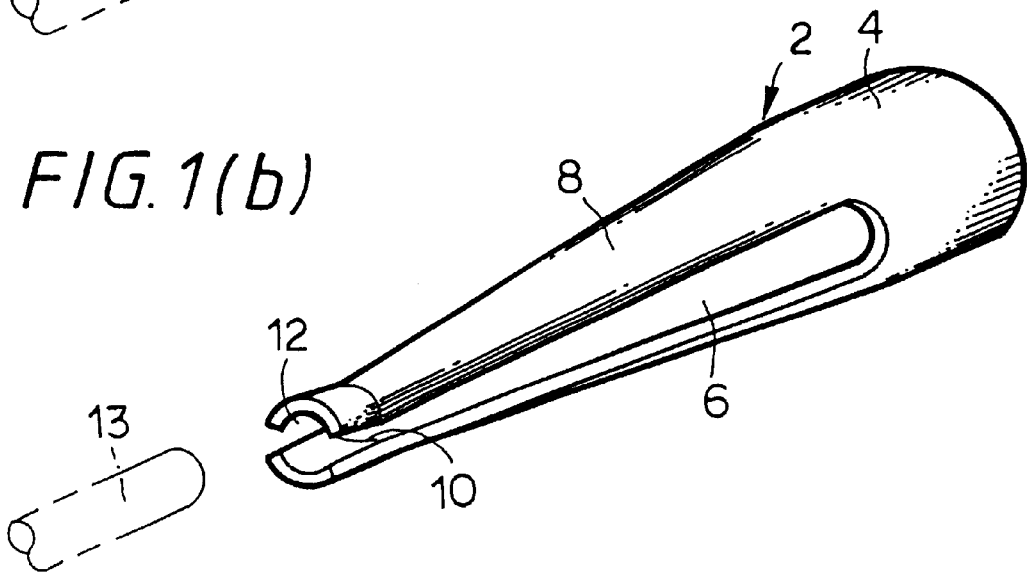

FIG. 1(*a*) is a perspective view of a gold-plated female metal terminal 1, and FIG. 1(*b*) is a perspective view of a tin-plated female metal terminal 2. Each of the two terminals is formed into a tubular shape as a whole from its proximal to its distal end, and the proximal end portion is formed into a completely-tubular portion 3, 4. The female metal terminal has two slits 5, 6 extending from the tubular portion 3, 4 to the distal end, and includes a pair of resilient contact piece portions 7, 8 of an arcuate cross-section separated from each other by the slits 5, 6, inner concave surfaces of the pair of resilient contact piece portions 7, 8 being opposed to each other. That portion of the female metal terminal, having the pair of resilient contact piece portions 7, 8, is decreasing in diameter progressively toward the distal end, and the distal end portion of a smallest diameter defines a contact portion 9, 10.

When a bar-like male terminal 13 is inserted into the female metal terminal through an insertion port 11, 12 at the distal end, the contact portion 9, 10 contacts this male terminal, thereby creating an electrical connection therebetween.

An opening 14 of an oval shape is formed through each of the resilient contact piece portions 7 of the gold-plated female metal terminal 1, and this opening 14 changes a longitudinal cross-sectional shape. As a result of the formation of this opening 14, the mechanical strength of the resilient contact piece portion 7 is reduced, and a contact load at the contact portion 9 is reduced, so that the female metal terminal 1 can contact the male terminal over a desired contact area.

Thus, although the gold-plated female metal terminal 1 in a developed condition has the same contour shape as that of the tin-plated female metal terminal 2, the appearance of the terminal 1 is greatly different from that of the terminal 2 because of the formation of the opening 14 through each resilient contact piece portion 7, and therefore the two kinds of female metal terminals 1 and 2 can be easily distinguished from each other.

Figure 2A:
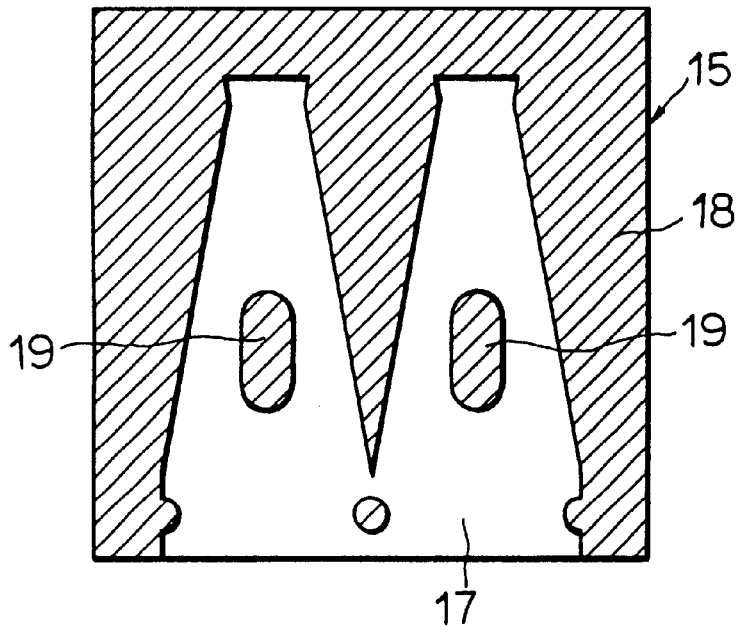
FIGS. 2(*a*) and 2(*b*) are views showing a die used for forming the female metal terminals of the first embodiment, FIG. 2(*a*) showing a reverse side of an upper die, and FIG. 2(*b*) showing an obverse side of a lower die.
Figure 2B:
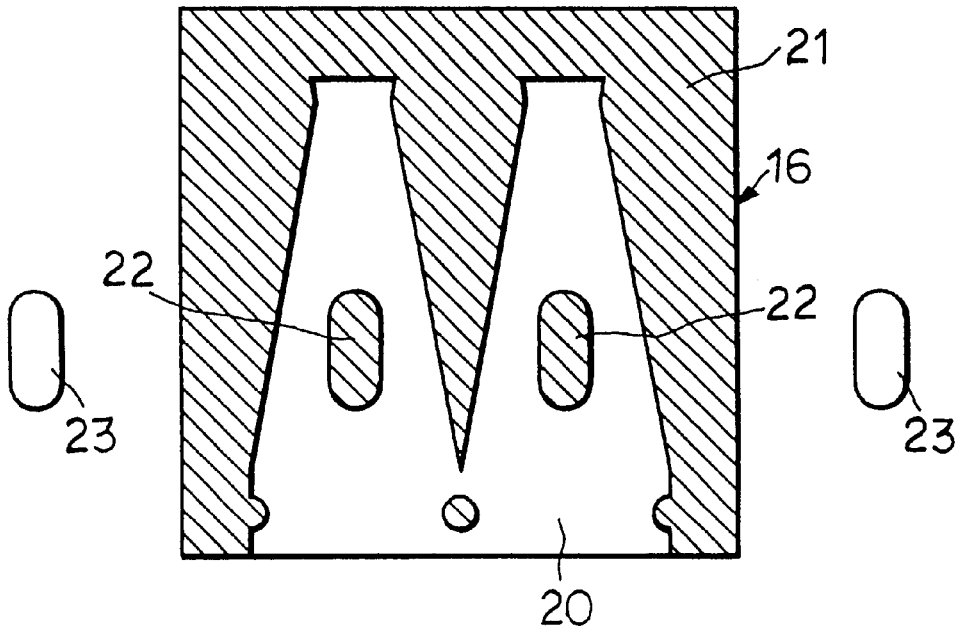
Figure 3:
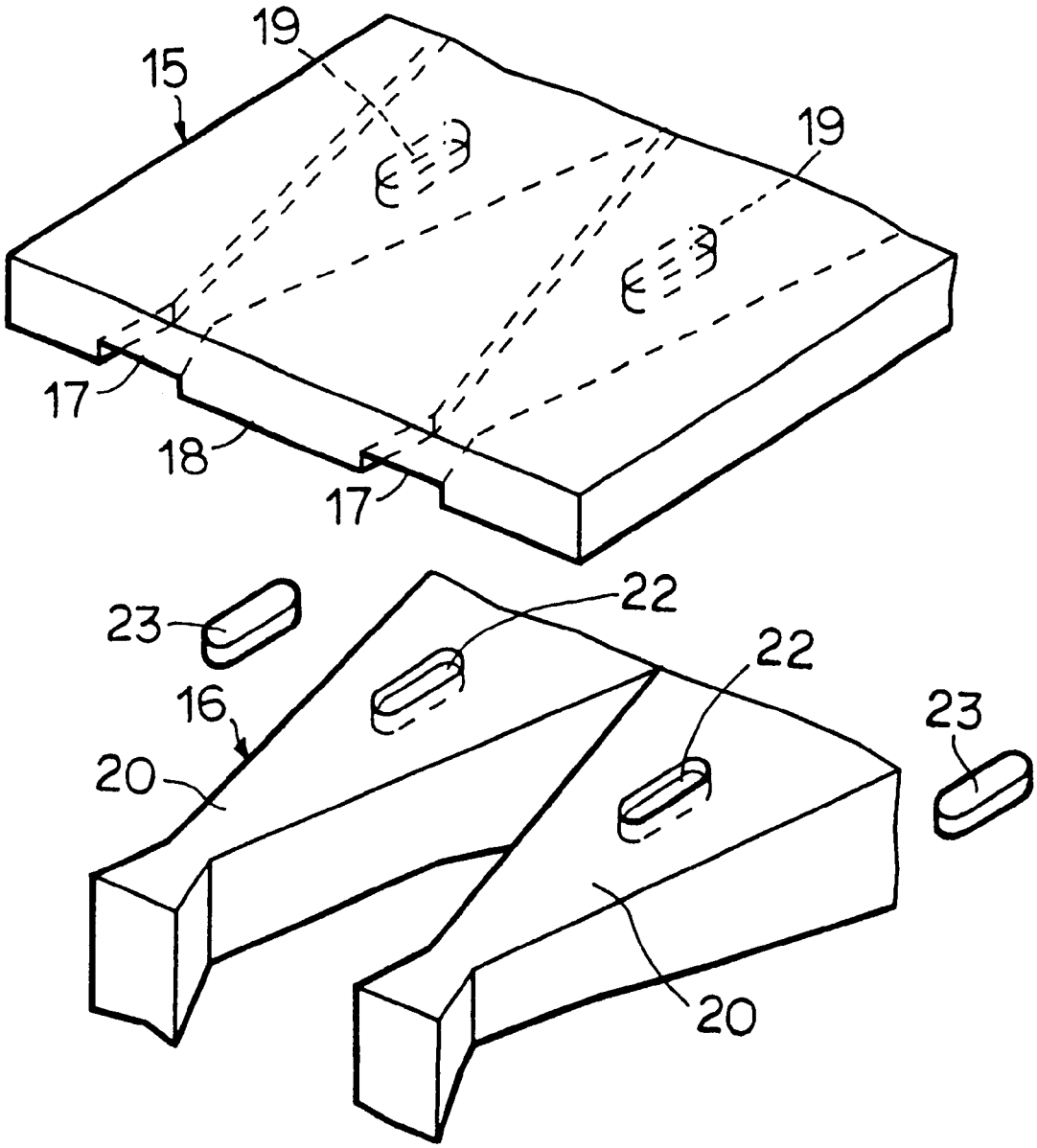
FIG. 3 is a perspective view showing a portion of each of the upper and lower dies.
Figure 4A:
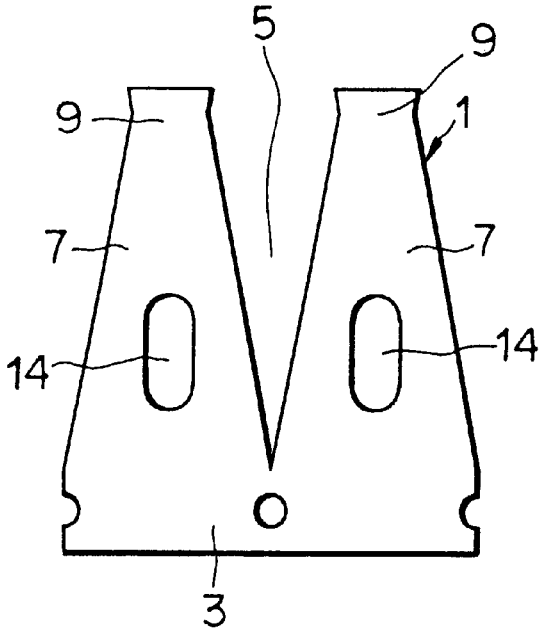
FIG. 4(*a*) is a developed plan view of the gold-plated female metal terminal in a pressed or stamped condition, and FIG. 4(*b*) is a developed plan view of the tin-plated female metal terminal in a pressed condition.
Figure 4B:
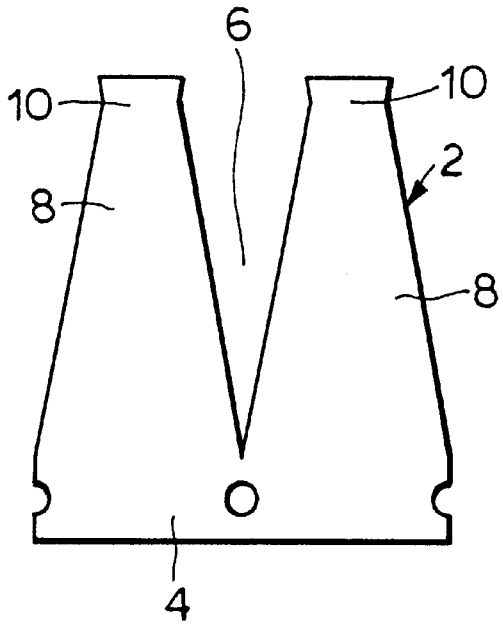

A method of forming the two kinds of female metal terminals 1 and 2 will be described with reference to FIGS. 2(*a*) and 2(*b*), FIG. 3 and FIGS. 4(*a*) and 4(*b*). FIGS. 2(*a*) and (*b*) show a common die used for forming the gold-plated female metal terminal 1 and the tin-plated female metal terminal 2, and FIG. 2(*a*) shows a reverse side of an upper die 15, and FIG. 2(*b*) shows an obverse side of a lower die 16. FIG. 3 is a perspective view showing a portion of each of the upper and lower dies 15 and 16. FIG. 4(*a*) is a developed plan view of the gold-plated female metal terminal 1 in a pressed or stamped condition, and FIG. 4(*b*) is a developed plan view of the tin-plated female metal terminal 2 in a pressed condition.

As can be seen from FIGS. 4(*a*) and 4(*b*), in a flattened condition (hereinafter referred to as "pressed, flattened shape") of each of the gold-plated and tin-plated female metal terminals 1 and 2 immediately after the pressing operation, each of the tubular portions 3 and 4 is flat, and the two resilient contact piece portions 7, 8 of a generally triangular shape are formed on the tubular portion 3, 4 in juxtaposed relation, and the opening 14 is formed through each of the resilient contact piece portions 7 of the gold-plated female metal terminal 1.

Therefore, the upper die 15 and the lower die 16 are so designed that these configurations can be obtained when the pressing operation is effected.

A recess 17, having a shape identical to the pressed, flattened shape, is formed in the upper die 15, and a convex portion 18 is formed around the recess 17. Projected portions 19 are removably mounted respectively on those portions of the upper die 15 corresponding respectively to the openings 14, and each projected portion 19 has an oval shape identical to the shape of the opening 14 (In FIG. 2(*a*), the convex portion 18 and the projected portions 19 are indicated by hatching).

A convex portion 20, having a shape identical to the pressed, flattened shape, is formed on the lower die 16, and a recess 21 is formed around the convex portion 20. Recessed portions 22 are formed respectively in those portions of the lower die 16 corresponding respectively to the openings 14, and each recessed portion 22 has an oval shape identical to the shape of the opening 14 (In FIG. 2(*b*), the recess 21 and the recessed portions 22 are indicated by hatching).

There are provided filling members 23 which are separate from the lower die 16, and each filling member 23 is identical in shape and thickness to the recessed portion 22. When the filling members 23 are fitted respectively into the recessed portions 22, the convex portion 20 of the lower die 16 has a flat surface.

The gold-plated female metal terminal 1 and the tin-plated female metal terminal 2 are pressed or stamped, using one set of upper and lower dies 15 and 16 of the above construction.

For pressing the gold-plated female metal terminal 1, the projected portions 19 are mounted on the upper die 15, and the recessed portions 22 in the lower die 16 are not filled. with the filling members 23, respectively. In this condition, the pressing is effected, and as a result, a blank is formed into the pressed, flattened shape with the openings 14, as shown in FIG. 4(*a*). This intermediate product of the pressed, flattened shape is formed into a tubular shape, thus providing the gold-plated female metal terminal 1 as shown in FIG. 1(*a*).

For pressing the tin-plated female metal terminal 2, the projected portions 19 are removed from the upper die 15, and the filling members 23 are fitted respectively into the recessed portions 22 in the lower die 16 so that the convex portion 20 of the lower die 16 is made flat. In this condition, the pressing is effected, and as a result, a blank is formed into the pressed, flattened shape without the openings 14 as shown in FIG. 4(*b*). This intermediate product of the pressed, flattened shape is formed into a tubular shape, thus providing the tin-plated female metal terminal 2 as shown in FIG. 1(*b*).

Thus, by selectively attaching and detaching the projected portions 19 and the filling members 23 which serve as cores, the gold-plated and tin-plated female metal terminals 1 and 2 can be formed by the use of one set of dies, and therefore the production cost is reduced, and also the purpose of the dies can be easily distinguished by confirming whether the projected portions 19 on the upper die 15, as well as the recessed portions 22 in the lower die 16, are present or absent.

A second embodiment of the present invention will now be described with reference to FIGS. 5(*a*) and 5(*b*).

Figure 5A:
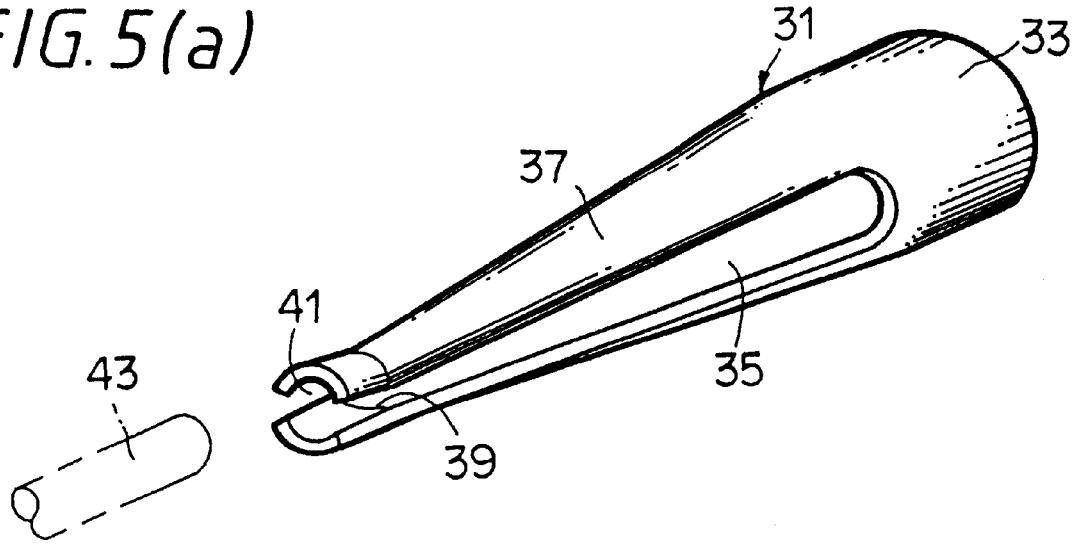
FIGS. 5(*a*) and 5(*b*) are perspective views of two kinds of female metal terminals according to a second embodiment of the invention, FIG. 5(*a*) showing a gold-plated female metal terminal, and FIG. 5(*b*) showing a tin-plated female metal terminal.
Figure 5B:
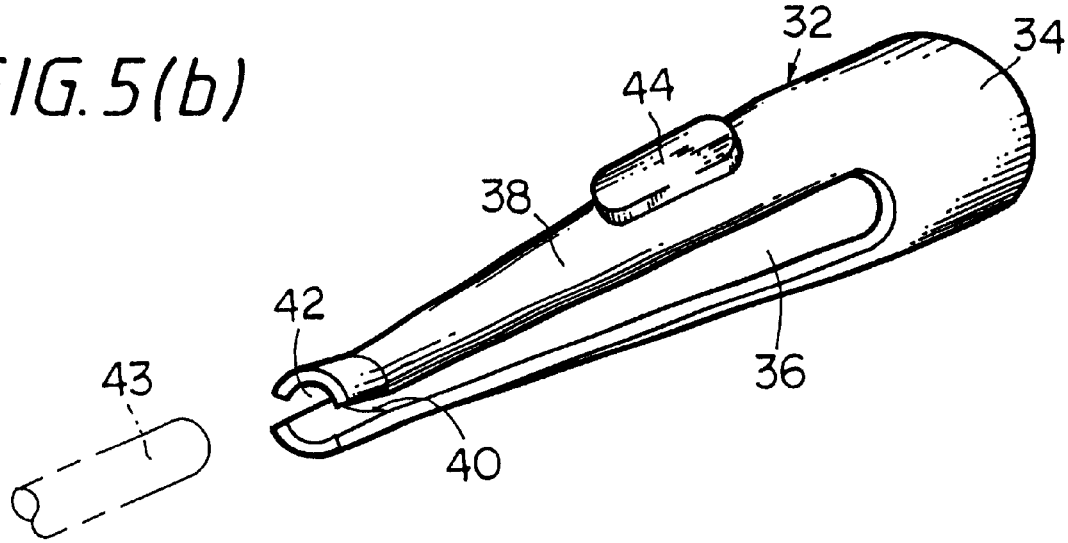

FIG. 5(*a*) is a perspective view of a gold-plated female metal terminal 31, and FIG. 5(*b*) is a perspective view of a tin-plated female metal terminal 32. Each of the two terminals has a proximal end portion formed into a completely-tubular portion 33, 34. The female metal terminal includes a pair of resilient contact piece portions 37, 38 separated from each other by slits 35, 36. That portion of the female metal terminal, having the pair of resilient contact piece portions 37, 38, is decreasing in diameter progressively toward a distal end thereof, and the distal end portion of a smallest diameter defines a contact portion 39, 40.

When a bar-like male terminal 43 is inserted into the female metal terminal through an insertion port 41, 42 at the distal end, the contact portion 39, 40 contacts this male terminal, thereby creating an electrical connection therebetween as in the first embodiment.

A projection 44 of a U-shaped cross-section is formed on an outer surface of each of the resilient contact piece portions 38 of the tin-plated female metal terminal 32, and this projection 44 changes a longitudinal cross-sectional shape. As a result of the formation of this projection 44, the mechanical strength of the resilient contact piece portion 38 is increased, and a contact load at the contact portion 40 is increased, so that the female metal terminal 32 can contact the male terminal over a desired contact area.

Thus, although the tin-plated female metal terminal 32 in a developed condition has the same contour shape as that of the gold-plated female metal terminal 31, the appearance of the terminal 32 is greatly different from that of the terminal 31 because of the formation of the projections 44, and therefore the two kinds of female metal terminals 31 and 32 can be easily distinguished from each other.

Figure 6A:
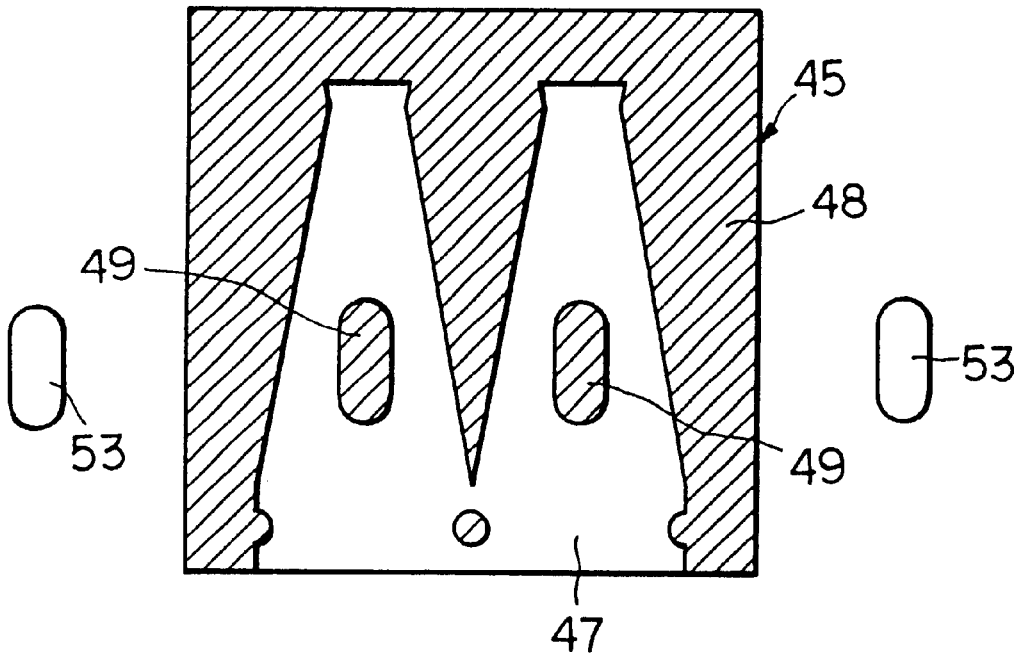
FIGS. 6(*a*) and 6(*b*) are views showing a die used for forming the female metal terminals of the second embodiment, FIG. 6(*a*) showing a reverse side of an upper die, and FIG. 6(*b*) showing an obverse side of a lower die.
Figure 6B:
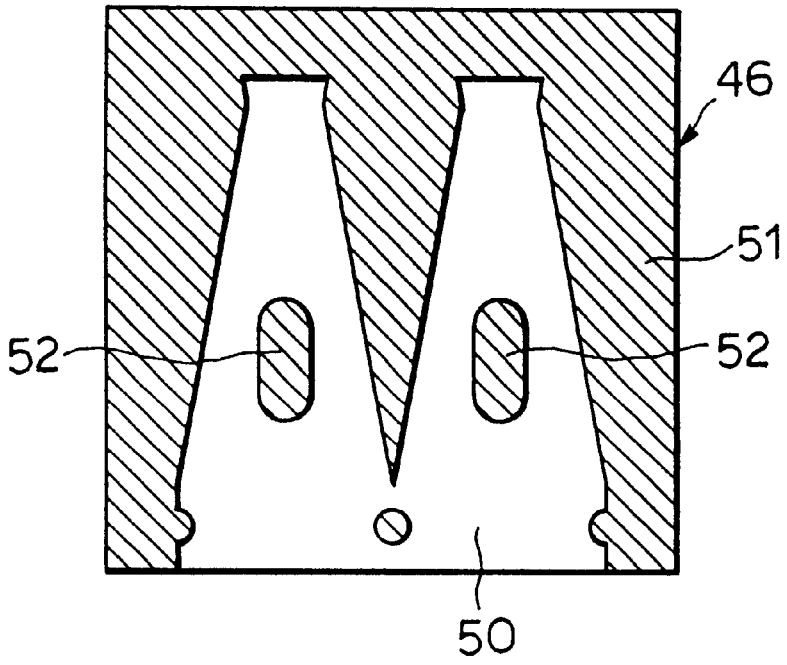
Figure 7:
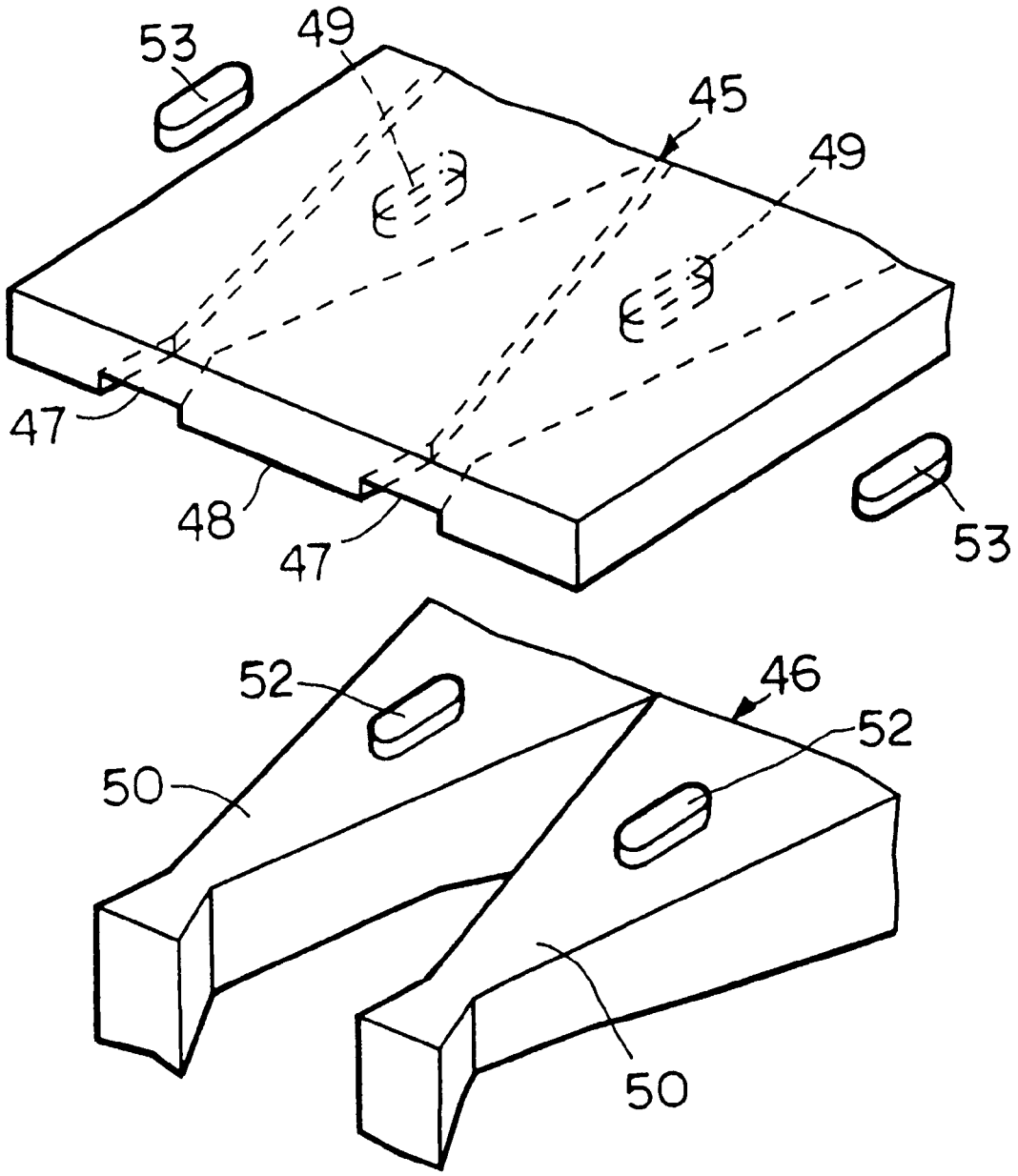
FIG. 7 is a perspective view showing a portion of each of the upper and lower dies.
Figure 8A:
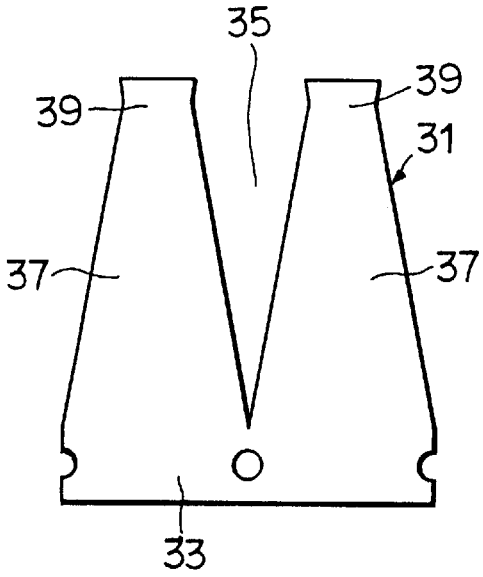
FIG. 8(*a*) is a developed plan view of the gold-plated female metal terminal in a pressed or stamped condition, and FIG. 8(*b*) is a developed plan view of the tin-plated female metal terminal in a pressed condition.
Figure 8B:
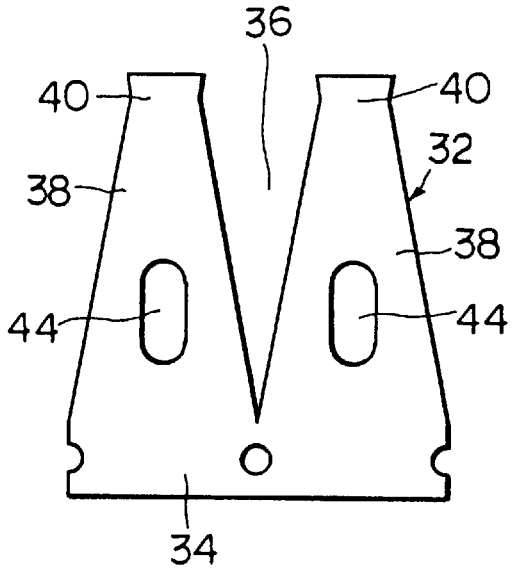
Figure 9A:
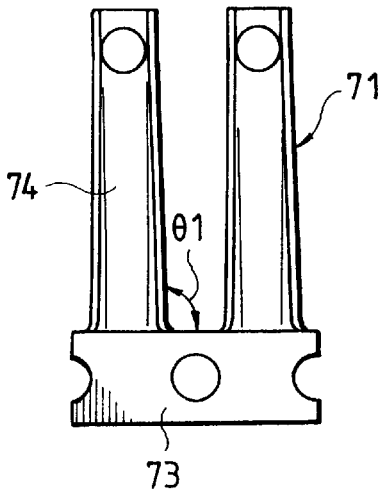
FIG. 9(a) PRIOR ART
FIG. 9(*a*) is a developed plan view of a conventional gold-plated female metal terminal in a pressed or stamped condition, and FIG. 9(*b*) is a developed plan view of a conventional tin-plated female metal terminal in a pressed condition.
Figure 9B:
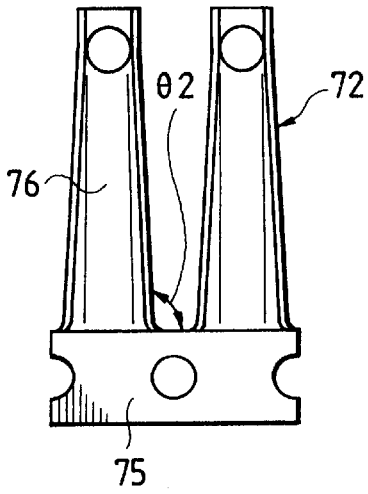
FIG. 9(b) PRIOR ART

A method of forming the two kinds of female metal terminals 31 and 32 will be described with reference to FIGS. 6(*a*) and 6(*b*), FIG. 7 and FIGS. 8(*a*) and 8(*b*). FIGS. 6(*a*) and 6(*b*) show a common die used for forming the gold-plated female metal terminal 31 and the tin-plated female metal terminal 32, and FIG. 6(*a*) shows a reverse side of an upper die 45, and FIG. 6(*b*) shows an obverse side of a lower die 46. FIG. 7 is a perspective view showing a portion of each of the upper and lower dies 45 and 46. FIG. 8(*a*) is a developed plan view of the gold-plated female metal terminal 31 in a pressed or stamped condition, and FIG. 8(*b*) is a developed plan view of the tin-plated female metal terminal 32 in a pressed condition.

As can be seen from FIGS. 8(*a*) and 8(*b*), as in the first embodiment, each of the gold-plated and tin-plated female metal terminals 31 and 32 in a pressed or stamped condition has a pressed, flattened shape, and each of the tubular portions 33, 34 is flat, and the two resilient contact piece portions 37, 38 of a generally triangular shape are formed on the tubular portion 33, 34 in juxtaposed relation, and the projection 44 is formed on each of the resilient contact piece portions 38 of the tin-plated female metal terminal 32.

Therefore, the upper die 45 and the lower die 46 are so designed that these configurations can be obtained when the pressing operation is effected.

A recess 47, having a shape identical to the pressed, flattened shape, is formed in the upper die 45, and a convex portion 48 is formed around the recess 47. Recessed portions 49 are formed respectively in those portions of the upper die 45 corresponding respectively to the projections 44, and each recessed portions 49 has a shape identical to an outer shape of the projection 44 (In FIG. 6(*a*), the convex portion 48 and the recessed portions 49 are indicated by hatching).

There are provided filling members 53 which are separate from the upper die 45, and each filling member 53 is identical in shape and thickness to the recessed portion 49. When the filling members 53 are fitted respectively into the recessed portions 49, the recess 47 in the upper die 45 has a flat surface.

A convex portion 50, having a shape identical to the pressed, flattened shape, is formed on the lower die 46, and a recess 51 is formed around one convex portion 50. Projected portions 52 are removably mounted respectively on those portions of the convex portion 50 of the lower die 46 corresponding respectively to the projections 44, and each projected portion 52 has a shape identical to the shape of the projection 44 (In FIG. 6(*b*), the recess 51 and the projected portions 52 are indicated by hatching).

The gold-plated female metal terminal 31 and the tin-plated female metal terminal 32 are pressed or stamped by using one set of upper and lower dies 45 and 46 of the above construction.

For pressing the tin-plated female metal terminal 32, the projected portions 52 are mounted on the lower die 46, and the recessed portions 49 in the upper die 45 are not filled with the filling members 53, respectively. In this condition, the pressing is effected, and as a result, a blank is formed into the pressed, flattened shape with the projections 44, as shown in FIG. 8(*b*). This intermediate product of the pressed, flattened shape is formed into a tubular shape, thus providing the tin-plated female metal terminal 32 as shown in FIG. 5(*b*).

For pressing the gold-plated female metal terminal 31, the filling members 53 are fitted respectively into the distinguishing recessed portions 49 in the upper die 45 to flatten the surface of the recess 47 in the upper die 45, and also the projected portions 52 are removed from the lower die 46. In this condition, the pressing is effected, and as a result, a blank is formed into the pressed, flattened shape without the projections 44. This intermediate product of the pressed, flattened shape is formed into a tubular shape, thus providing the gold-plated female metal terminal 31 as shown in FIG. 5(*a*).

Thus, by selectively attaching and detaching the projected portions 52 and the filling members 53 which serve as cores, the gold-plated and tin-plated female metal terminals 31 and 32 can be formed by the use of one set of dies, and therefore the cost of the dies and hence the production cost are reduced, and also the purpose of the dies can be easily distinguished by confirming whether the recessed portions 49 in the upper die 45, as well as the projected portions 52 on the lower die 46, are present or absent.

In the above embodiment, although the opening 14, serving as the longitudinal cross-sectional shape-changing portion, is formed through each of the resilient contact piece portions 7, 8, this opening 14 may be replaced by a groove with a closed bottom.

In the above two embodiments., although there are provided the openings 14 and the projections 44 serving as the longitudinal cross-sectional shape-changing portions, the present invention is not limited to such configurations, and they may be replaced by grooves with a closed bottom, cylindrical projections, or the like.

In the above two embodiments, although the openings 14 and the projections 44 have an oval shape, the invention is not limited to such configurations, and any other suitable shape, such as a circular shape and a square shape, can be adopted.

In the above two embodiments, although there are shown two kinds of female metal terminals, that is, the gold-plated and tin-plated female metal terminals, the invention can also be applied to female metal terminals of other material.

As described above, in the female metal terminals and the method of producing the the female metal terminal of the present invention, by changing the longitudinal cross-sectional shape of the resilient contact piece portions of the female metal terminal, the load of contact with the male metal terminal can be adjusted in accordance with the electrical conductivity of the plating material, without changing the contour shape in a developed condition. Although the plurality of kinds of female metal terminals have the same contour shape, they can be clearly distinguished from each other from the appearance since the cross-sectional shape of the resilient contact piece portions is changed. Therefore, when the gold-plated female metal terminal and the tin-plated female metal terminals are both used as in an automobile, they will not be mistaken in the production, and the handling is easy.

Moreover, in the female metal terminals and the method of producing the female metal terminal of the present invention, by changing the longitudinal cross-sectional shape of the resilient contact piece portions of the female metal terminal, the contact load can be adjusted. Therefore, the plurality of kinds of female metal terminals, plated respectively with the different materials, can be provided merely by the use of the pair of dies and the removable cores. Further, as described above, two kinds of female metal terminals can be produced by one set of dies, and therefore the cost of the dies is reduced, and hence the production cost is reduced, and the purpose of the dies can be easily distinguished by confirming whether the cores are present or absent, and a confusion in the production is eliminated.

What is claimed is:

1. A method of producing female metal terminals plated respectively with different materials, comprising the steps of:

forming, by pressing with a single die set, a female metal terminal which includes resilient contact piece portions, and a tubular portion supporting said resilient contact piece portions in a cantilever manner, a longitudinal cross-sectional shape of said resilient contact piece portions being changed so that a load of contact of the female metal terminal with a male metal terminal can be adjusted in accordance with electrical conductivity of a plating material, without changing a contour shape of the female metal terminal in a pressed condition; and forming said resilient contact piece portions and said tubular portion, formed by said pressing operation, into a tubular shape.

2. A method of producing female metal terminals according to claim 1, in which an opening is formed in an outer surface of each of said resilient contact piece portions, so that the longitudinal cross-sectional shape is changed.

3. A method of producing female metal terminals according to claim 1, in which a projection is formed on an outer surface of each of said resilient contact piece portions, so that the longitudinal cross-sectional shape is changed.

* * * * *